US008221193B2

(12) United States Patent
Chang et al.

(10) Patent No.: US 8,221,193 B2
(45) Date of Patent: Jul. 17, 2012

(54) CLOSED LOOP CONTROL OF PAD PROFILE BASED ON METROLOGY FEEDBACK

(75) Inventors: Shou-Sung Chang, Stanford, CA (US); Hung Chih Chen, Sunnyvale, CA (US); Stan D Tsai, Fremont, CA (US); Yuchun Wang, Santa Clara, CA (US)

(73) Assignee: Applied Materials, Inc., Santa Clara, CA (US)

( * ) Notice: Subject to any disclaimer, the term of this patent is extended or adjusted under 35 U.S.C. 154(b) by 982 days.

(21) Appl. No.: 12/187,675

(22) Filed: Aug. 7, 2008

(65) Prior Publication Data

US 2010/0035518 A1 Feb. 11, 2010

(51) Int. Cl.
*B24B 49/12* (2006.01)
*B24B 49/18* (2006.01)

(52) U.S. Cl. ..... 451/6; 451/5; 451/72

(58) Field of Classification Search ..... 451/56, 451/72, 6, 5, 443, 444
See application file for complete search history.

(56) References Cited

U.S. PATENT DOCUMENTS

| | | | | |
|---|---|---|---|---|
| 5,609,718 | A | 3/1997 | Meikle | 156/626.1 |
| 5,655,951 | A | 8/1997 | Meikle | |
| 5,801,066 | A | 9/1998 | Meikle | 438/14 |
| 5,951,370 | A | 9/1999 | Cesna | |
| 5,975,994 | A | 11/1999 | Sandhu | |
| 6,040,244 | A | 3/2000 | Arai et al. | |
| 6,045,434 | A | 4/2000 | Fisher, Jr. et al. | 451/6 |
| 6,129,609 | A | 10/2000 | Ripper et al. | |
| 6,186,864 | B1 | 2/2001 | Fisher, Jr. et al. | |
| 6,194,231 | B1 | 2/2001 | Ho-Cheng et al. | |
| 6,203,413 | B1 | 3/2001 | Skrovan | |
| 6,264,532 | B1 | 7/2001 | Meloni | |
| 6,343,974 | B1 | 2/2002 | Franca et al. | |
| 6,354,910 | B1 | 3/2002 | Adebanjo et al. | |
| 6,537,133 | B1 | 3/2003 | Birang et al. | |
| 6,554,688 | B2 | 4/2003 | Lacy | |
| 6,616,513 | B1 | 9/2003 | Osterheld | |
| 6,684,704 | B1 | 2/2004 | Obeng | |
| 6,872,132 | B2 | 3/2005 | Elledge | |
| 7,033,246 | B2 | 4/2006 | Elledge | |
| 7,033,248 | B2 | 4/2006 | Elledge | |
| 7,070,478 | B2 | 7/2006 | Elledge | |
| 7,070,479 | B2 | 7/2006 | Faustmann et al. | |
| 7,258,596 | B2 | 8/2007 | Elledge et al. | |
| 7,359,069 | B2 | 4/2008 | Tanaka et al. | |
| 2004/0038623 | A1* | 2/2004 | Chandrasekaran | 451/5 |
| 2004/0192168 | A1* | 9/2004 | Faustmann et al. | 451/5 |
| 2004/0203328 | A1 | 10/2004 | Tada et al. | |
| 2005/0208879 | A1 | 9/2005 | Paik | 451/5 |
| 2007/0281592 | A1* | 12/2007 | Benner | 451/72 |

* cited by examiner

*Primary Examiner* — Robert Rose
(74) *Attorney, Agent, or Firm* — Dergosits & Noah LLP

(57) ABSTRACT

A chemical mechanical polishing apparatus includes a metrology system that detects the thickness of the polishing pad as semiconductor wafers are processed and the thickness of the polishing pad is reduced. The chemical mechanical polishing apparatus includes a controller that adjusts the rate of material removal of a conditioning disk when areas of the polishing surface are detected that are higher or lower than the adjacent areas of the polishing pad.

20 Claims, 9 Drawing Sheets

CLOSED LOOP CONTROL OF PAD PROFILE BASED ON METROLOGY FEEDBACK

FIELD OF INVENTION

The present invention relates to a method and apparatus for conditioning a polishing pad used in chemical mechanical polishing (CMP) to manufacture semiconductor devices.

BACKGROUND

A conventional CMP machine includes a rotating polishing pad, a wafer carrier that is coupled and a conditioning disk. During CMP processing, liquid slurry of abrasive particles in a fluid is poured onto the rotating polishing pad and a semiconductor wafer is placed in the wafer carrier. The wafer carrier presses the wafer against the slurry and the rotating polishing pad while the carrier arm moves the wafer across the width of the polishing pad. The chemical reaction with the slurry and the physical erosion due to the contact with the abrasive particles causes material to be removed from the wafer and evens out any irregular topography, making the exposed wafer surface planar. The conditioning disk generally includes a diamond abrasive surface that is moved and rotated against the polishing pad. The conditioning disk keeps the particles removed from the wafer from accumulating on the polishing surface and maintaining the uniform abrasive character of the polishing pad.

As wafers are processed, the polishing pad is also worn down and eventually must be replaced. A problem with the CMP process is that the polishing surface of the pad can become uneven during wafer processing. An uneven polishing surface cannot polish a wafer properly and may result in uneven or defective wafer processing. Accordingly, what is needed is a CMP system control system that monitors the uniformity of the polishing surface and prevents uneven wear of the CMP polishing pad.

SUMMARY OF THE INVENTION

The present invention is directed towards a system and method for maintaining the uniformity of the polishing surface of the polishing pad. The system includes a rotating polishing pad, a wafer carrier, a conditioning disk, a metrology system and a closed-loop control system. The wafer carrier holds the wafer against the rotating polishing pad that is coated with abrasive slurry. The carrier rotates and moves the wafer across the width of the polishing pad. As material is removed from the wafer and the wafer is polished to a smooth flat surface. During CMP processing, the conditioning disk is also moved across the width of the polishing pad. The conditioning disk preferably has an abrasive surface that includes many small diamonds that move over the polishing pad and cleans the wafer particles from the polishing pad. The thickness of the polishing pad is monitored by the metrology system during the CMP processing.

The metrology system can detect the thickness of all areas of the polishing surface by placing a distance sensor at a fixed distance over the polishing pad and taking distance measurements. The thickness can be determined by subtracting the distance measurements from the known distance between the sensor and the bottom of the polishing pad. The system can be store the thickness measurements and used this information to produce a profile or a thickness map of the polishing pad. If any uneven areas of the polishing pad are detected, the control system controls the conditioning disk to adjust the rate of material removal for uneven area of the polishing pad.

The polishing pad measurement can be used to create a graphical profile representation of the polishing pad. The profile resembles a cross sectional view of the polishing pad with the vertical axis representing variations in the polishing pad thickness and the horizontal axis representing the radial positions across the width of the polishing pad. Since the polishing pad rotates about its center, the disk tends to wear in a radial pattern. By knowing the thicknesses of each radial position across the polishing pad, the topography for the entire polishing surface can be estimated.

In contrast, a thickness map provides thickness measurements for the entire area of the polishing pad. In order to produce the thickness map, the polishing pad surface can be divided into many distinct areas defined by a coordinate system. In an embodiment, a polar coordinate system is used to define each area of the polishing pad by rotational and radial coordinates. The system can then produce the thickness map for the polishing pad by correlating the thickness measurements with the radial and rotational positions. The thickness map may utilize contrasts in color or darkness to differentiate thick and thin areas of the polishing pad. The thickness map will be able to identify uneven surfaces that do not extend in a circular manner around the polishing pad.

The sensors used to detect the polishing pad thickness can be configured in various ways over the polishing pad. In an embodiment, one or more distance sensors may be mounted to a movable structure such as a movable carriage that slides along a fixed track over the polishing pad. Alternatively, the sensors can be attached to an arm that allows that moves the sensors over the width of the polishing pad. In yet another embodiment, a plurality of sensors may be mounted in a fixed manner with each sensor placed over a different radial position of the polishing pad. The sensors can include laser, chromatic white light, inductive, CETR pad probe, ultrasonic, etc. The polishing pad thickness measurements can be made ex-situ between wafer processing or in-situ during wafer processing. Since the polishing pad rotates, all areas of the pad can be moved under the sensor or within the detection range of the sensors.

The system can analyze the thickness measurement data to determine if the wear rate of the polishing pad is even or if there are any non-uniform areas of the pad. If a high area or a low area of the polishing pad is detected, the system can control the conditioning disk to correct the defect. The controller can increase the rate of material removal to reduce the thickness of high areas. There are various ways to increase the rate of material removal including: applying a greater compression force on the conditioning disk against the polishing pad, increasing the rate of rotation of the conditioning disk, and increasing the time that the conditioning disk is placed over the high areas of the polishing pad. Conversely, if the system detects a low area of the polishing pad, the system can reduce the rate of material removal by reducing the compression of the conditioning disk over the low areas of the polishing pad, reducing the rate of rotation of the conditioning disk or reducing the time that conditioning disk is placed over the low areas.

Since the variations in the polishing pad surface are quantified, the corrective actions can be proportional to the level of variation in the polishing pad thickness. For example, a large increase in the rate of material removal may be used to reduce a large protrusion detected in the polishing surface. As the system detects that the protrusion is becoming smaller, the system can reduce the rate of material removal proportionally.

In an embodiment, the conditioning disk can include a sensor that detects the force applied by the conditioning disk to the polishing pad. The sensor can be a force transducer that detects the compression of the conditioning disk against the polishing pad. In another embodiment, the sensor can be a torque transducer that detects the torque applied to the conditioning disk by the conditioning disk motor. The system can maintain a constant the compressive force or torque applied to the conditioning disk over normal areas of the polishing pad and can detect variations in the force applied to the conditioning disk over uneven areas of the polishing pad.

When a minimum polishing pad thickness is detected, the system produces an end of life signal and the polishing pad can be replaced. The system can also detect when the variations in the thickness of the polishing surface are beyond repair and emit an end of life signal. Because the inventive system maintains a uniform polishing pad surface, the life of the polishing pad is extended so each polishing pad can be used to properly process the maximum number of wafers.

DETAILED DESCRIPTION

Figure 1:
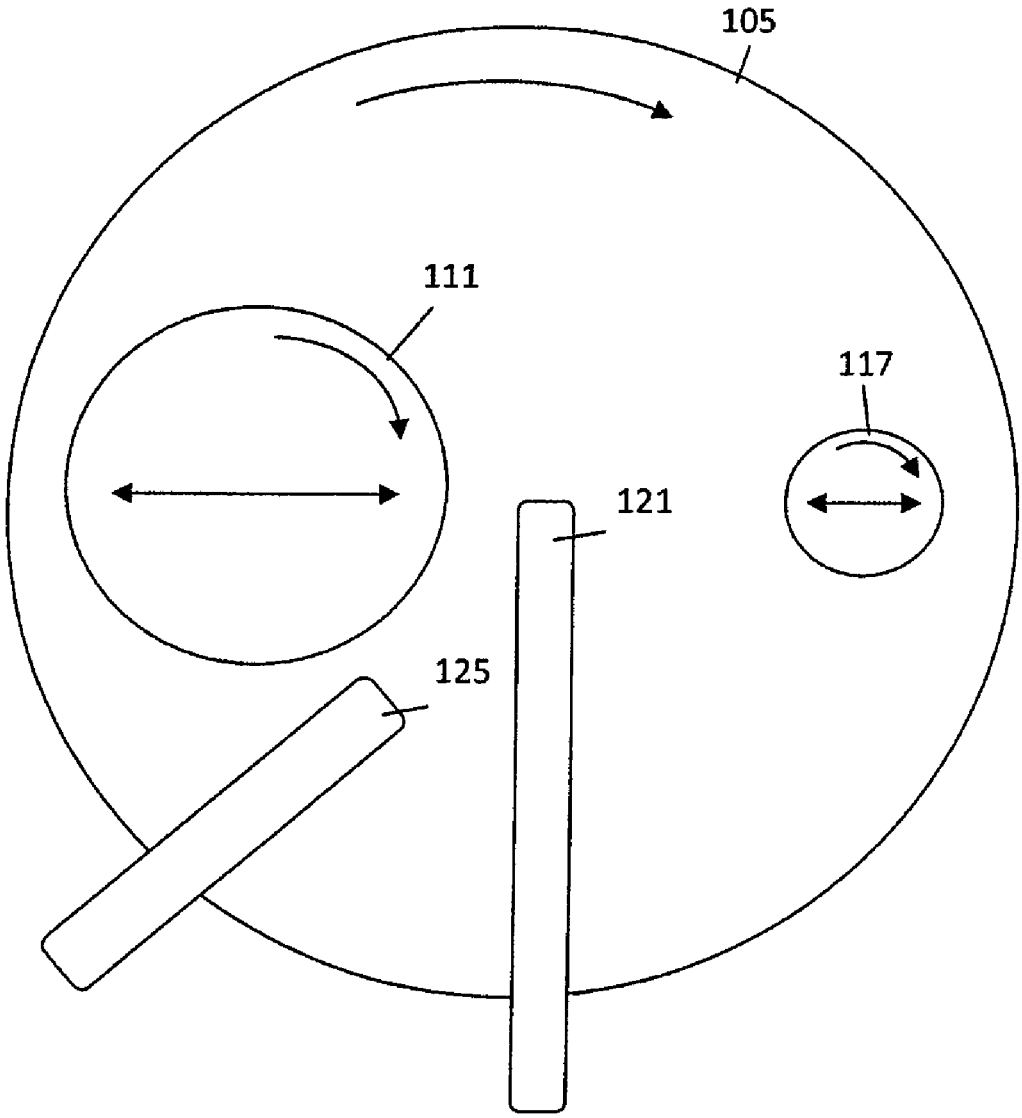
FIG. 1 illustrates a top view of a CMP system.

The present invention is directed towards an improved apparatus and method for maintaining a uniform thickness of a polishing pad during CMP processing. The inventive system monitors the thickness of the CMP polishing pad and makes adjustments to the conditioning pad to maintain a uniform polishing pad thickness. With reference to FIG. 1, the inventive CMP system includes a rotating circular polishing pad 105, a wafer carrier mechanism 111, a conditioning disk 117 and a polishing pad metrology system 121. During CMP processing, abrasive slurry is poured onto the polishing pad 105 by a slurry distribution mechanism 125. The wafer carrier mechanism 111 rotates and moves the wafer over the slurry and across the width of the rotating polishing pad 105. The conditioning disk 117 includes an abrasive surface that contacts the polishing pad 105 and removes wafer particles from the polishing surface. The conditioning disk 117 is pressed against the polishing pad 105 and is swept back and forth across the width of the polishing pad 105.

The polishing pad metrology system includes one or more sensors 121 that detect the distance from the sensor 121 to the upper surface of the polishing pad 105. The thickness of the polishing pad is calculated by subtracting the measured distance from the known distance between the sensor 121 and the bottom of the polishing pad 105. The sensor 121 can be configured to take measures at incremental radial positions across the width of the polishing pad 105. A new polishing pad 105 will have a uniform thickness and a planar upper surface. As the polishing pad 105 wears, the thickness of the pad 105 will decrease. By measuring the changes in the distance between the sensor and the upper surface of the polishing pad 105, the system can detect variations in the polishing pad 105 thickness.

Figure 2:
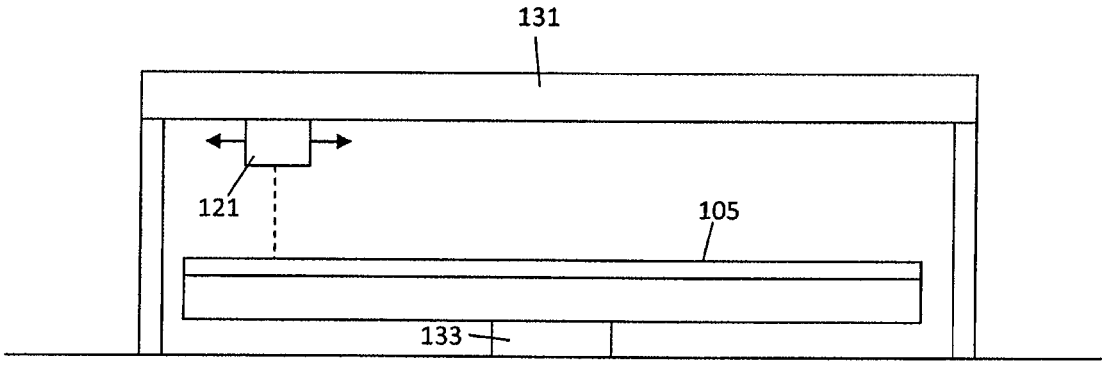
FIG. 2 illustrates an embodiment of a CMP system having a fixed sensor track.

The sensor can detect the polishing pad thickness in various different ways. With reference to FIG. 2, in an embodiment, one or more sensors are attached to a fixed track 131 mounted at a fixed vertical distance over the CMP polishing pad 105. The sensor 121 can measure the vertical distance to the top of the polishing pad. The sensor 121 may be moved on the track 131 across the width or radius of the polishing pad 105 and vertical measurements can be taken at incremental radial positions. The system may also include a rotational detector 133 for providing a rotational position of the polishing pad, so each measurement can have an associated radial and rotational position.

Figure 3:
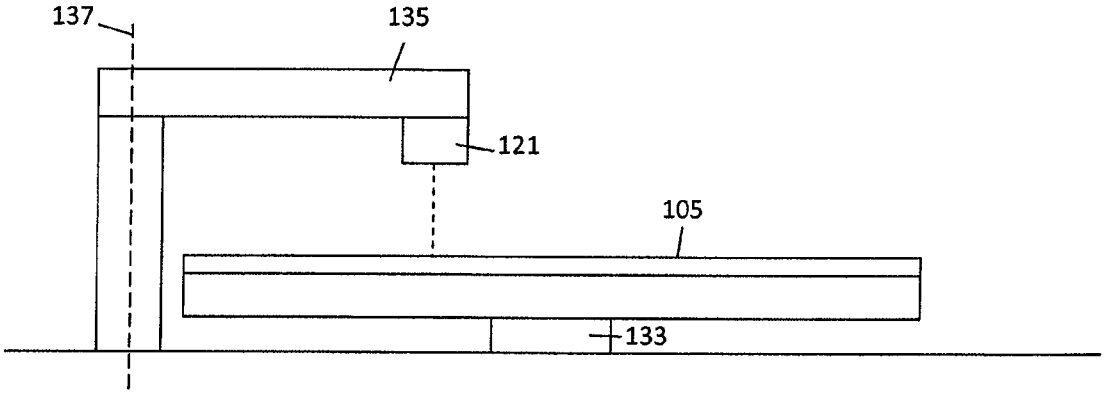
FIG. 3 illustrates an embodiment of a CMP system having a movable sensor arm.

With reference to FIG. 3, in an embodiment, the sensor 121 may be coupled to a movable arm 135 structure that moves the sensor 121 across the width of the polishing pad 105. The movable arm 135 may rotate about a vertical pivot axis 137 that is perpendicular to the polishing pad 105 so that the sensor 121 is always at the same vertical distance from the regardless of the position of the arm 135. The length of the movable arm 135 must be long enough to move the sensor 121 across the radius of the polishing pad 105. By moving the sensor 121 across the width or radius of the rotating polishing pad 105, the thickness of all areas of the polishing pad can be measured.

Figure 4:
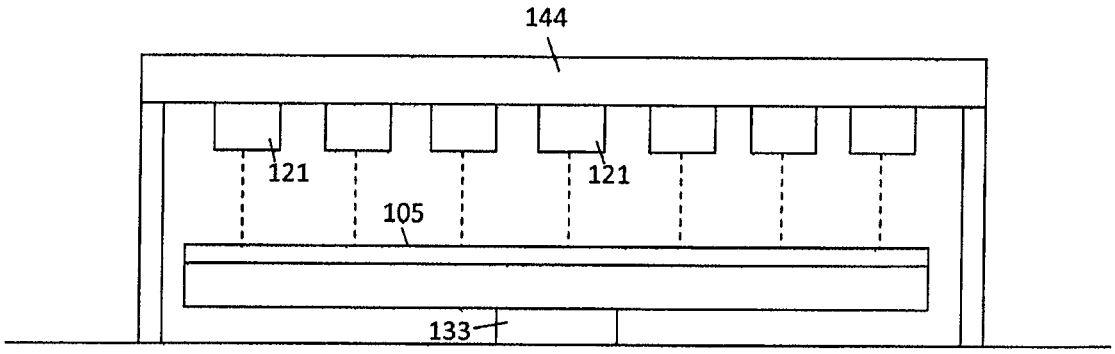
FIG. 4 illustrates an embodiment of a CMP system having fixed sensors.

With reference to FIG. 4, a plurality of sensors 121 may be mounted in a fixed manner across the radius or diameter of the polishing pad 105. Each sensor 121 may be mounted to a beam 144 over a different radial position of the polishing pad 105. Since there are many sensors 121, each can take distance measurements simultaneously without movement of the sensors 121. Since the sensors 121 are not coupled to a moving mechanism, there is less chance of positional errors due to movement of the sensors 121. In an embodiment, the sensors 121 may be mounted in a staggered manner with each sensor 121 having a different radial position over the polishing pad 105. As the polishing pad 105 rotates, the system can take thickness measurements so the thicknesses for all areas of the polishing pad 105 can be recorded.

The inventive polishing pad metrology system can be configured to measure various features of polishing pad surface including: polishing pad profile, polishing pad topography, groove depth, etc. When the system is configured to measure the pad profile, the thicknesses for radial positions across the polishing pad are measured. The measurements may be averaged to determine the thickness of each concentric circular area of the polishing pad. By combining all of the average thickness measurements across width of the polishing pad, a graphical polishing pad profile is generated. Since the polishing pad rotates, it will wear in a circular pattern around the center of rotation and the profile thickness measurements provide an accurate representation of the entire polishing pad. By monitoring the changes in the pad profile during wafer processing, defects in the polishing pad surface can be detected.

Figure 5:
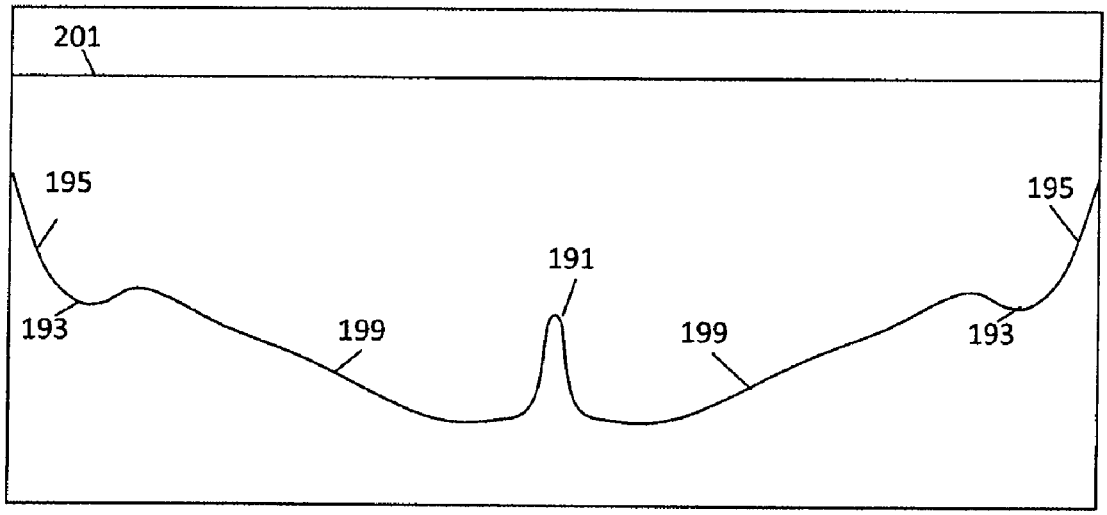
FIG. 5 illustrates an exemplary detected pad profile.

With reference to FIG. 5, exemplary pad profiles are illustrated. In order to clearly illustrate the variations in thickness, the length scale of the vertical axis is substantially larger than the scale of the horizontal axis. When a polishing pad is new, the pad is at a full thickness and the pad profile is uniform as represented by the horizontal line 201. As the pad wears, the pad thickness is reduced and variations in thickness across the width of the polishing pad become visible. In this example, polishing pad thickness rises at the center 191 and outer diameter 195 since these areas may not be used to polish the wafers. The middle area 199 of the polishing pad is thinner than the outer diameter 195 and slopes towards the center. Since the wafer carrier includes a gimbaled mechanism that keeps the wafer flat against the polishing pad, a smooth sloped polishing surface in the middle area 199 may not be detrimental to the CMP wafer processing. However, the polishing pad profile also illustrates a dip 193 defect at the area close to the outer diameter 195. Since the dip 193 is an area that will not contact the wafer with the same pressure as the adjacent areas, this defect can result in uneven polishing and potential damage to the wafers that are processed. By graphically illustrating the pad profile, the system or an operator can detect defects in the polishing surface of the pad. In the preferred embodiment, the system will detect the dip 193 and adjust the control of the conditioning pad to reduce any additional wear at this area. As the thicknesses of the adjacent areas of the polishing pad are reduced, the dip will be removed resulting in a uniform polishing surface.

Figure 6:
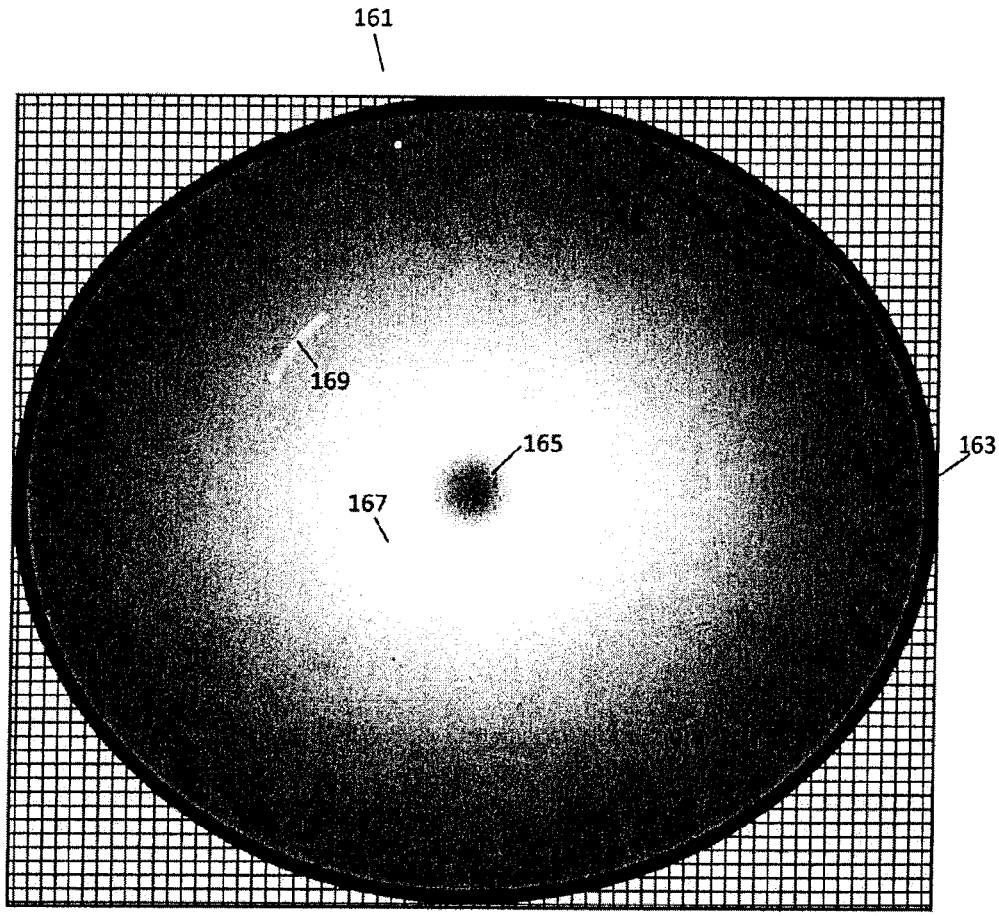
FIG. 6 illustrates an exemplary pad thickness map.

In other embodiments, the system may detect the thicknesses for all areas of the polishing pad. The thicknesses for the entire polishing pad can then be mapped in a grid such as X, Y coordinate system or a polar coordinate system. By using a coordinate system the individual thickness measurements for all areas of the polishing pad can be illustrated on a thickness map. With reference to FIG. 6, a thickness map 161 for the entire polishing pad is illustrated on an X,Y coordinate grid. The thickness of the polishing pad may be represented by variations in the colors or the darkness of the areas of the polishing pad. In this example, the darker shading represent thicker areas of the polishing pad while lighter shading represent thinner areas. The outer edge 163 and the center of the polishing pad 165 are darker and thicker than the middle area 167.

In this example, a defective area 169 of the polishing pad is illustrated. The defective area 169 is lighter than the adjacent areas which is an indication that the defective area 169 is thinner than the adjacent areas. Since the area 169 does not extend all the way around the polishing pad, this type of defect may not be detected by a profile polishing pad detection system described above.

Figure 7:
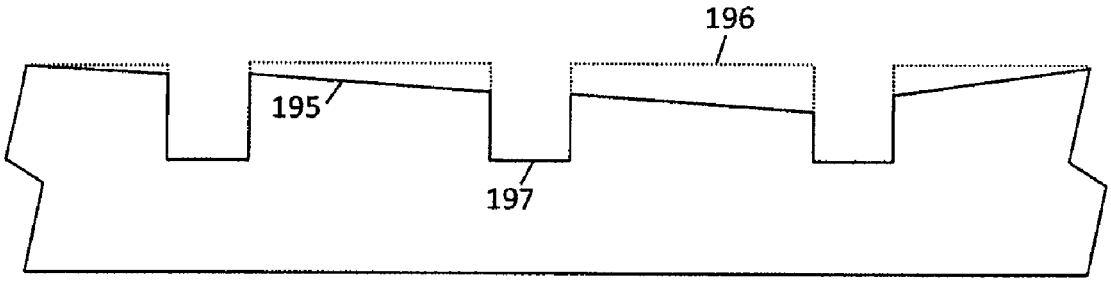
FIG. 7 illustrate a block diagram of the CMP control system.

In another embodiment, the metrology system can also be used to measure the depth of the grooves in the polishing pad. The grooves in the CMP polishing pad are generally in a pattern of concentric circles that are spaced apart at different radial positions. Alternatively, the groove may have a spiral pattern relative to the center of the polishing pad or any other pattern. The grooves provide a reservoir for the slurry during the CMP processing. By measuring the groove depth, the thickness of the polishing pad adjacent to the groove can be determined. With reference to FIG. 7, the dotted lines 186 represent the cross sectional upper surface of a new polishing pad and the lower solid line 195 represents the upper surface of a worn polishing pad. When the polishing pad is new, the distances between the dotted line 196 and the bases 197 of the grooves are all the same. As the polishing pad processes wafers, material is removed from the upper surface of the polishing pad and the distances from the solid line 195 to the bases 197 of the grooves become different. Since the grooves may extend across the entire width of the polishing pad, the variations in groove depths can indicate that areas that are uneven in thickness.

The polishing pad thickness measurements can be made ex-situ between wafer processing and/or in-situ during wafer processing. Since the polishing pad may process several hundred wafers, the measurement of the pad thickness between wafers can be practical. For ex-situ measurements the slurry may be removed from the polishing pad before the thicknesses are measured. This allows the system to avoid interference or errors in the thickness measurements due to the layer of slurry on the polishing pad. The polishing pad may be held stationary while the thickness measurements are taken and then rotated so that all areas of the polishing pad are measured. Alternatively, the thickness measurements can be takes while the polishing pad is rotating. Since the system detects the rotational position of the polishing pad, a polar coordinate system may be the preferred means for defining the individual areas of the polishing pad associated with the thickness measurements.

In other embodiments, the sensor(s) measures the variations in thickness of the stationary polishing pad. The sensors may record one or more thicknesses and then be moved to a new position and stopped to measure additional thicknesses. The thicknesses of the entire polishing pad or representative areas of the polishing pad can be measuring in a sequential manner. In this embodiment, the sensors may associate the thicknesses measurements of the polishing pad with X, Y location coordinates.

If the polishing pad thickness is measured in-situ, thickness measurements are taken through the layer of slurry. In these embodiments, the sensor readings may not be affected by the slurry. The platter that the polishing pad is mounted on may have a rotational sensor that provides a rotational position for the polishing pad. As the polishing pad rotates the system can detect the rotational position of the pad as well as the radial position of the sensor(s). The system can then associate the radial and rotational coordinates of the polishing pad with the thickness measurements. With reference to FIG. 1, in order to minimize the effects of the slurry, the metrology system 121 may be located at an upstream position adjacent to the slurry distribution mechanism 125. Thus, the slurry is dispersed by both the wafer carrier 111 and the conditioning disk 117 before the thickness of the polishing pad 105 is detected by the metro logy system 121.

Figure 8:
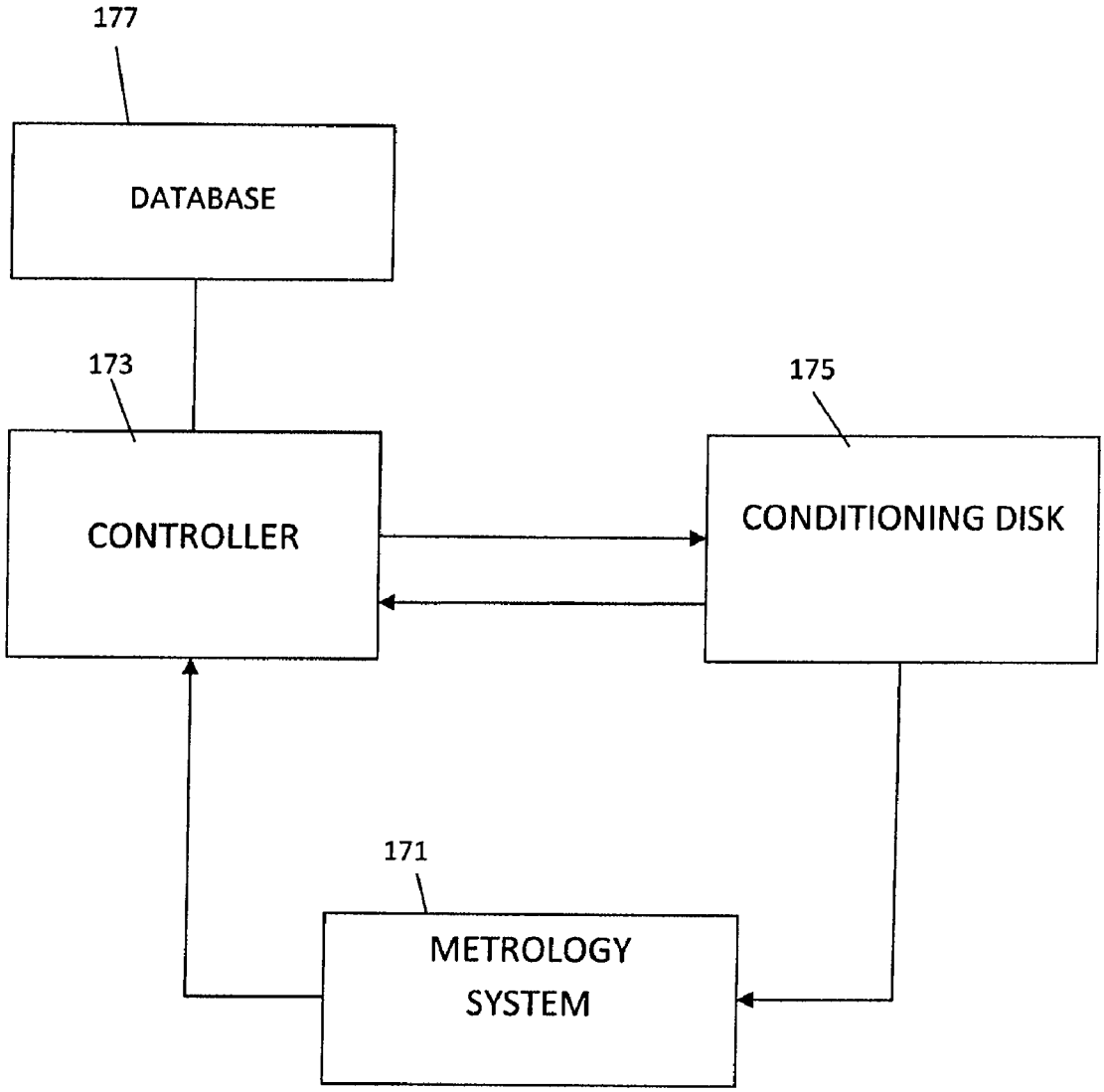
FIG. 8 illustrates a cross section of a polishing pad with grooves.
Figure 9:
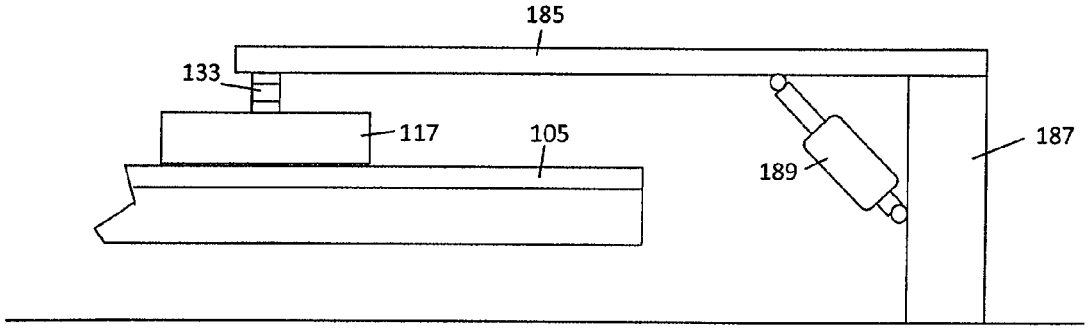
FIG. 9 illustrates an embodiment of a conditioning disk arm.

With reference to FIG. 8, a block diagram of the closed loop control system is illustrated. The polishing pad thickness sensor of the pad metrology system 171 is coupled to a process controller 173 that monitors the polishing pad thickness measurements. Based upon the thickness measurements, the controller 173 can adjust the rate of material removal of the conditioning pad 175 for areas of the polishing pad that are out of thickness uniformity. The metrology system 171 may detect the corrections in the thickness as the defective areas are corrected by the conditioning disk.

As discussed, the system can be used in ex-situ and in-situ modes of operation. In the ex-situ operation, the thicknesses of the polishing pad can be measured between wafer processing by the metrology system 171. The controller 173 can respond to information regarding defective areas in the polishing pad 175 by adjusting the rate of material removal over the defective areas during processing of the following wafer. As the thickness defects are corrected, the metrology system will detect the corrections and the controller 173 will control the conditioning pad 175 to perform a more uniform material removal across the polishing pad.

In the in-situ mode, the metrology system 171 measures the polishing pad thickness during CMP processing and will immediately detect any variations in thickness. The controller 173 can respond by adjusting the rate of material removal by the conditioning disk 175. As the conditioning disk 175 corrects the defective area, the metrology system 171 will sense the correction and the controller 173 will reduce the corrective actions of the conditioning disk 175. In addition to feedback from the metrology system 171, the system may also utilize feedback from a force sensor coupled to the conditioning disk 175. By monitoring the force sensor, the control system can detect the altered physical processing of defects on the polishing pad by the conditioning disk 175.

Various polishing pad thickness detection methods are possible. For example, in an embodiment, the system may take multiple thickness measurement readings and throw out the higher and lower readings and average the remaining readings. Thus, any individual measurement errors in the sensor detection will be filtered from the system. Since the surface of the polishing pad is not perfectly smooth, an average of many measurements may produce a more accurate indication of the pad thickness. As discussed, the system can associated the thickness measurements with a radius position on the polishing pad or any other information that indicates the corresponding measured area of the polishing pad.

As discussed, the system can also use the thickness information to plot the topography of the polishing surface and/or create thickness maps. These graphical representations of the polishing pad can be displayed in real time as CMP processing is taking place. In an embodiment, the system can be coupled to a database 177 of polishing pad profiles or thickness maps. This information can be used to optimize the CMP processing and function as a comparable standard for processing performance. The system can compare the profiles or thickness maps for the polishing pad to a database of prior polishing pad data. For example, the system may store cumulative and optimum polishing pad profiles or thickness maps for number of wafers that have been processed. Thus, the normal polishing pad profile for a pad that has processed a specific number of wafers can be determined. If a significant difference is detected between a polishing pad and the expected thickness from the database 177, the system can emit a signal indicating that an anomaly has been detected and potential processing errors may be occurring.

By knowing the locations of variations in the polishing pad thickness, the controller can make adjustments to the CMP processing to optimize the polishing pad and extend the life of the polishing pad. In an embodiment, the controller is used to control to the operation of the conditioning disk to compensate for any irregularities in the polishing pad by applying different control signals to the conditioning disk. For example, if a high area of the polishing pad is identified, the system can cause the conditioning disk to remove more material from the high areas of the polishing pad. Conversely, if a low spot is detected, the conditioning disk can be controlled to remove less material.

Various factors can control the rate of polishing pad material removal including: compressive force, torque applied to the conditioning disk, rate of rotation and time that the conditioning disk is placed over an area of the polishing pad. In an embodiment, the high areas can be reduced by applying a higher compressive force to the conditioning disk to increase the rate of material removal from the polishing pad. With reference to FIG. 8, the condition disk may be coupled to an arm 185 that includes an actuator 189 that controls the compressive force between the conditioning disk 117 and the polishing pad 105. The arm 185 can be coupled to a rotational actuator 187 that rotates the arm 185 and controls the position of the conditioning disk 117 across the width of the polishing pad 105. By knowing the position of the arm 185 and the rotational position of the polishing pad 105, the controller can determine the area of the polishing pad 105 that is under the conditioning disk 117. While the compression actuator 189 is illustrated as a linear actuator, the compression actuator 189 can include various other types of mechanisms including: a rotational actuator, a pneumatic actuator or any other type of force mechanism.

When an area of the polishing pad 105 that is higher than the adjacent areas is determined to be under the conditioning disk 117, the controller can increase the compressive force of the actuator 189 so the conditioning disk 117 is pressed against the polishing pad 105 with greater force to increase the rate of material removal. As the high area is lowered and becomes closer in thickness uniformity to the rest of the polishing pad 105, the system can detect the reduced thickness and reduce the increased compression until the area is uniform no longer in need of special processing. The compressive force applied to the conditioning disk can range from about 0 to 20 pounds of force. The increased compressive pressure will depend upon the area of the conditioning pad 117 based upon the formula: Pressure=Compressive Force/Conditioning Pad area. Thus, a conditioning pad that is 4.25 inches in diameter will have a surface area of 14.19 square inches. For force of 0-20 pounds will result in a pressure range from 0 to 1.41 pounds per square inch.

The rate of material removal from the polishing pad 105 can also be controlled by varying the rate of rotation of the conditioning disk 117. By increased the rate of rotation for the abrasive conditioning disk 117, the rate of material removal is increased. If a high area is detected, the system can increase the rate of rotation conditioning disk 117 to increase polishing pad 105 material removal rate when the conditioning disk 117 is over the high area. Conversely, if a low area is detected, the system can decrease the rotational rate of the conditioning disk 117 when the conditioning disk 117 is over the low area of the polishing pad 105. As the polishing pad 105 thickness becomes more uniform, the variation in the rate of rotation of the conditioning disk 117 can be reduced so the rate of material removal can be uniform across the polishing pad. The rate of rotation of the conditioning disk 117 can range from about 0 to 200 RPM.

Yet another method for altering the rate of polishing pad 105 material removal is to vary the time that the conditioning disk 117 is over an area of the polishing pad 105. The rate of material removal is increased when the area of the polishing pad 105 has a greater exposure time to the conditioning disk 117. During normal CMP processing, the conditioning disk 117 moves at a uniform rate of radial movement across width of the polishing pad 105. The normal sweep rate of the conditioning disk 117 across the polishing pad 105 may be about 25 sweeps per minute. The high areas of the polishing pad 105 can be lowered by increasing the contact time by reducing the sweep rate when the conditioning disk 117 is positioned over the high areas. Thus, rather than a uniform rate of movement across the width, the system can reduce the rate of radial movement over the high areas so the conditioning disk 117 spends more time over the high areas than the other uniform thickness areas of the polishing pad 105. Conversely, the conditioning pad 117 can decrease the contact time with thinner areas of the polishing pad 105 by increasing the sweep rate over the thinner areas. By monitoring the thickness of the defective areas of the polishing pad 105, the controller can continuously adjust the rate of material removal rate to correct defects in the polishing surface and make the polishing surface more uniform. Thus, the system can be used to monitor and maintain the uniformity of the polishing surface.

In an embodiment, the conditioning disk system may include a sensor 133 that coupled to the conditioning disk 117, so the system can detect the forces applied to the polishing pad 105. In an embodiment the sensor 133 may be a force transducer mounted between the conditioning disk 117 and the arm 185. The force transducer 133 can measure the compressive force applied by the arm 185 to the conditioning disk 117. The controller can monitor the compression force and adjust the actuator 189 until the desired compression and rate of material removal is detected.

In another embodiment, the sensor 133 may be a torque transducer which detects the torque applied to rotate the conditioning disk 117. As the abrasive surface of the conditioning disk 117 and polishing pad are worn, the coefficient of friction between the conditioning disk 117 and polishing pad may be reduced. Thus, additional compressive force on the conditioning disk 117 may be required to obtain the same rate of material removal from a worn polishing pad 105. Thus, the torque applied to the conditioning disk 117 may be proportional to the rate of material removal from the polishing pad 105. As the polishing pad 105 and conditioning disk 117 are worn down, a higher compression may be required to produce the same torque and rate of material removal. The system may adjust to compressive force so that the torque applied to the conditioning disk is maintained constant.

Since the conditioning disk may be about 4.25 inches in diameter, it can be difficult to correct small defects on the polishing pad. As discussed, the inventive system can produce a thickness map of all areas of the polishing pad can be used to identify the areas of the polishing pad that have defects. If a small defect area is found to be an improper height, devices other than the conditioning disk can be used to remove high spots on the polishing pad. Since the inventive CMP system can identify the locations of the defective areas, the user may be able to make repairs to the defective areas.

Different types of sensors can be used to measure the polishing pad thickness. Sensors suitable for polishing pad metrology include: laser, chromatic white light, inductive, CETR pad probe, ultrasonic, etc. The sensor(s) can be moved over the polishing pad in order to detect the pad thickness. The thickness detection can be performed during wafer processing or in between the processing of wafers. In the preferred embodiment, the detection of the polishing pad thickness is performed when the polishing pad is covered with slurry, however in another embodiment, the pad thickness detection is performed on a dry pad which requires the removal of the slurry.

Laser sensors direct a laser light at the polishing pad surface and the reflected light is detected. Based upon the reflected light, the distance between the sensor and the surface can be precisely calculated. Because the speed of light is constant, a pulse of laser light can be precisely and the system can detect the time it takes a light pulse to contact the surface being measured and receive the rebounded pulse. Alternatively, the light based distance measurement will be based upon interferometry. While the laser beam will most easily detect a clean polishing pad that has the slurry cleaned from the surface, it is also possible to detect the polishing pad thickness by directing the laser beam through a thin layer of slurry to the surface of the polishing pad and detecting the reflected light.

In another embodiment, a chromatic white light can be used to detect variations in the polishing pad surface. A beam of light can be directed at the polishing pad and the reflected images are detected by a sensor, the diameter of the white light is substantially larger than that of a laser beam. Thus, fewer measurements may be required to determine the thicknesses of an entire polishing pad.

The proximity detector comprises an oscillating circuit composed of a capacitance in parallel with an inductance that forms the detecting coil which produces a magnetic field. The current flowing through the inductive loop changes when the sensor is in proximity to other objects and the change in current can be detected. By measuring the change in current, the distance to the object can be determined.

Mechanical probes can also be used to detect the polishing pad thickness. The probe is generally an elongated structure having an end that contacts the polishing pad. By knowing the extension of the probe from a fixed point to the surface of the polishing pad, the thickness of the polishing pad can be determined. It can be difficult to use the mechanical probe during the CMP processing since the movement of the polishing pad can cause damage to the probe. Thus, the probes are preferably used to measure stationary polishing pads. Since the probe can be pressed through the slurry the sensor readings will not be influenced by the slurry.

An ultrasonic sensor determines the thickness of the polishing pad by interpreting the echoes from ultra high frequency sound waves. Ultrasonic sensors generate high frequency sound waves and evaluate the echo which is received back by the sensor. Sensors calculate the time interval between sending the signal and receiving the echo to determine the distance to an object. By knowing the position of the sensor and receiver, the thickness of the polishing pad can be determined.

Different types of sensors can be preferable to other sensors depending upon the application. With reference to Table 1 below, the most appropriate application of the sensors is indicated. Sensors that have a small detection area such as laser, inductive and probe are more suitable for precise measurements of specific areas of the polishing pad. In contrast, wider area sensors such as chromatic white light and ultrasonic sensors are better at detecting topography. Since the larger area sensors are groove depth.

TABLE 1

| | Laser | Chromatic White Light | Inductive | Probe | Ultrasonic |
|---|---|---|---|---|---|
| Pad Profile | X | | X | X | |
| Topography | | X | | | X |
| Groove Depth | X (on dry pad) | X | | | X |

It will be understood that the inventive system has been described with reference to particular embodiments, however additions, deletions and changes could be made to these embodiments without departing from the scope of the inventive system. Although the CMP systems that have been described include various components, it is well understood that these components and the described configuration can be modified and rearranged in various other configurations.

What is claimed is:

1. An apparatus for chemical mechanical polishing comprising:

a rotatable polishing pad having a polishing surface;

a conditioning disk that is movable across the polishing pad and has an abrasive surface that moves against the polishing surface;

an actuator coupled to the conditioning disk;

a metrology sensor that detects thicknesses of the polishing pad;

a controller coupled to the actuator that controls a position of the conditioning disk and a rate of material removal by the conditioning disk; and a database coupled to the controller for storing a thickness map for the polishing pad created from the thicknesses of each polar coordinate location detected by the metrology sensor;

wherein the controller adjusts the rate of material removal when the conditioning disk is over the polar coordinate location associated with a defective area of the polishing pad.

2. The apparatus of claim 1 wherein the metrology system includes a light source and a light detector.

3. The apparatus of claim 1 wherein if the thickness of an area of the polishing pad is thicker than adjacent areas, the controller increases the rate of material removal of the conditioning disk when the conditioning disk is over the area of the polishing pad.

4. The apparatus of claim 3 wherein the rate of material removal is increased by increasing a compression force of the conditioning disk against the polishing surface.

5. The apparatus of claim 1 wherein if the thickness an area of the polishing pad is thinner than adjacent areas of the polishing pad, the controller decreases the rate of material removal of the conditioning disk when the conditioning disk is over the area of the polishing pad.

6. The apparatus of claim 5 wherein the rate of material removal is decreased by decreasing a compression force of the conditioning disk against the polishing surface.

7. The apparatus of claim 1 wherein the controller transmits an end of life signal when the metrology system detects that the thickness of at least one area of the polishing pad is below a predetermined thickness.

8. A method for chemical mechanical polishing comprising:

rotating a polishing pad having a polishing surface;

moving a conditioning disk across the polishing pad;

measuring thicknesses of areas of the polishing pad with a metrology sensor;

storing a thickness map for the polishing pad created from the thicknesses of each polar coordinate location detected by the metrology sensor;

detecting an area of the polishing pad that is thicker or thinner than adjacent areas;

adjusting a rate of material removal from the polishing pad by the conditioning disk when the conditioning disk is over the polar coordinate location associated with a defective area of the polishing pad that is thicker or thinner than the adjacent areas on the thickness map.

9. The method of claim 8 further comprising:

storing the thicknesses of the areas of the polishing pad detected by the metrology sensor and the areas of the polishing associated with the thicknesses in a memory.

10. The method of claim 8 further comprising:

moving the metrology sensor across a radius of the polishing pad.

11. The method of claim 8 further comprising:

increasing the rate of material removal of the conditioning disk over the area of the polishing pad if the thickness of the area is thicker than the adjacent areas of the polishing pad.

12. The method of claim 11 further comprising:

increasing a rate of rotation of the conditioning disk when the conditioning disk is over the area of the polishing pad that is thicker than the adjacent areas.

13. The method of claim 11 further comprising:

increasing a compression force of the conditioning disk against the polishing disk when the conditioning disk is over the area of the polishing pad that is thicker than the adjacent areas.

14. The method of claim 11 further comprising:

increasing a time of contact between the conditioning disk and the polishing disk when the conditioning disk is over the area of the polishing pad that is thicker than the adjacent areas.

15. The method of claim 8 further comprising:

decreasing the rate of material removal of the conditioning disk over the area of the polishing pad if the thickness of the area is thinner than the adjacent areas of the polishing pad.

16. The method of claim 15 further comprising:

decreasing a rate of rotation of the conditioning disk when the conditioning disk is over the area of the polishing pad that is thinner than the adjacent areas.

17. The method of claim 15 further comprising:

decreasing a compression force of the conditioning disk against the polishing disk when the conditioning disk is over the area of the polishing pad that is thinner than the adjacent areas.

18. The method of claim 15 further comprising:

decreasing a time of contact between the conditioning disk and the polishing disk when the conditioning disk is over the area of the polishing pad that is thinner than the adjacent areas.

19. The method of claim 8 further comprising:

transmitting an end of life signal when the metrology system detects that the thickness of the polishing pad is below a predetermined thickness.

20. The method of claim 8 further comprising:

transmitting an end of life signal when the metrology system detects that the thickness of an area of the polishing pad is thicker or thinner than the adjacent areas by a predetermined thickness.

* * * * *